US008860638B2

(12) United States Patent
Kim et al.

(10) Patent No.: US 8,860,638 B2
(45) Date of Patent: Oct. 14, 2014

(54) PIXEL AND ORGANIC LIGHT EMITTING DISPLAY DEVICE HAVING THE SAME

(75) Inventors: Chang-Yeop Kim, Yongin (KR); Ki-Myeong Eom, Yongin (KR); Won-Kyu Kwak, Yongin (KR); Kwang-Min Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1043 days.

(21) Appl. No.: 12/757,265

(22) Filed: Apr. 9, 2010

(65) Prior Publication Data

US 2011/0025585 A1 Feb. 3, 2011

(30) Foreign Application Priority Data

Jul. 31, 2009 (KR) ..... 10-2009-0070545

(51) Int. Cl.
*G09G 3/32* (2006.01)

(52) U.S. Cl.
CPC ..... *G09G 3/3233* (2013.01); *G09G 2300/0852* (2013.01); *G09G 3/3291* (2013.01); *G09G 2300/0847* (2013.01)
USPC ..... 345/82

(58) Field of Classification Search
CPC ..... G09G 3/3208
USPC ..... 345/82
See application file for complete search history.

(56) References Cited

U.S. PATENT DOCUMENTS 6,184,702 B1 2/2001 Takahashi et al.
2002/0067455 A1* 6/2002 Komatsu ..... 349/141

(Continued)

FOREIGN PATENT DOCUMENTS

JP 2005-518557 A 6/2005
JP 2008-145648 6/2008

(Continued)

OTHER PUBLICATIONS

Korean Office Action dated Sep. 20, 2011 issued in Korean Priority Application No. 10-2009-0070545, 1 page.

*Primary Examiner* — Claire X Pappas
*Assistant Examiner* — Robert Stone
(74) *Attorney, Agent, or Firm* — Christie, Parker & Hale, LLP

(57) ABSTRACT

A pixel including: an organic light emitting diode that is coupled between a first power supply and a second power supply; a first transistor that is coupled between the first power supply and the organic light emitting diode and whose gate is connected to a first node; a second transistor that is coupled between the first node and a data line and whose gate electrode is coupled to a scan line; and a storage capacitor whose first electrode is coupled to the first node and second electrode is coupled to the first power supply, wherein the storage capacitor includes: a semiconductor layer that is positioned on a different layer from that of the data line and that expands to a region where the semiconductor layer overlaps with the data line and constitutes the first electrode, a first dielectric layer that is formed on the semiconductor layer, a first conductive layer that is formed on the first dielectric layer and constitutes the second electrode, a second dielectric layer that is formed on the first conductive layer, and a second conductive layer that is formed on the second dielectric layer and constitutes the first electrode together with the semiconductor layer, the first conductive layer being positioned between the data line and the semiconductor layer in order to cover the upper part of the region where it overlaps with the data line of the semiconductor layer.

18 Claims, 3 Drawing Sheets

(56) References Cited

U.S. PATENT DOCUMENTS

| | | | | |
|---|---|---|---|---|
| 2004/0135940 | A1* | 7/2004 | Tsunekawa et al. | 349/110 |
| 2004/0178742 | A1 | 9/2004 | Date et al. | |
| 2006/0007218 | A1* | 1/2006 | Miyake et al. | 345/204 |
| 2006/0267885 | A1* | 11/2006 | Kwak et al. | 345/76 |
| 2007/0048886 | A1* | 3/2007 | Winters et al. | 438/29 |
| 2008/0079005 | A1* | 4/2008 | Tseng | 257/72 |
| 2008/0165174 | A1* | 7/2008 | Ozawa | 345/211 |
| 2008/0217624 | A1* | 9/2008 | Kwak et al. | 257/71 |
| 2009/0009094 | A1 | 1/2009 | Choi et al. | |
| 2009/0189173 | A1* | 7/2009 | Shibata et al. | 257/98 |
| 2011/0108844 | A1* | 5/2011 | Kwak et al. | 257/71 |

FOREIGN PATENT DOCUMENTS

| | | | |
|---|---|---|---|
| KR | 1020050107865 | A | 11/2005 |
| KR | 1020060000362 | A | 1/2006 |
| KR | 1020060000848 | A | 1/2006 |

* cited by examiner

PIXEL AND ORGANIC LIGHT EMITTING DISPLAY DEVICE HAVING THE SAME

CROSS-REFERENCE TO RELATED APPLICATIONS

This application claims the benefit of Korean Patent Application No. 10-2009-0070545, filed on Jul. 31, 2009, in the Korean Intellectual Property Office, the disclosure of which is incorporated herein by reference.

BACKGROUND OF THE INVENTION

1. Field of the Invention

An embodiment of the present invention relates to a pixel and an organic light emitting display device having the same, and more particularly, to a pixel that can stably maintain the voltage of the data signal stored in a storage capacitor, while sufficiently securing the capacity of the storage capacitor, and an organic light emitting display device having the same.

2. Description of the Related Art

Recently, various flat panel display devices that have light weight and small volume compared to a cathode ray tube have been developed.

Among the flat panel display devices, an organic light emitting display device displays an image using organic light emitting diodes that are self-light emitting elements which are advantageous in brightness and color over traditional display devices, making them the next generation display device.

The organic light emitting display device as described above is divided into a passive matrix organic light emitting display device and an active matrix organic light emitting display device according to the scheme by which the organic light emitting display device is driven.

Among others, the active matrix organic light emitting display device includes a plurality of pixels positioned on intersections of scan lines and data lines, wherein each pixel includes an organic light emitting diode and a pixel circuit that drives the organic light emitting diode. Such an active matrix organic light emitting display device is advantageous in view of small power consumption, high resolution, and large area compared to the passive matrix organic light emitting display device.

The pixel circuit of the general active matrix organic light emitting display device includes a switching transistor that transfers a data signal to the inside of the pixel when a scan signal is supplied, a storage capacitor that stores the data signal transferred to the inside of the pixel, and a driving transistor that supplies the driving current corresponding to the data signal to the organic light emitting diode.

The organic light emitting diode emits light at the brightness corresponding to the driving current from the driving transistor. Therefore, in order for the organic light emitting diode to emit light at a constant brightness during the emission periods of the respective frames, the data signal stored in the storage capacitor of the respective pixels should be stably maintained, and have a predetermined value, during the emission period of the corresponding frame.

However, recently, as the resolution of the organic light emitting display device increases, it is becoming more difficult to design space for forming the pixel circuit.

Therefore, there is an increased demand for a method for effectively using the limited design space.

Moreover, for the normal emission of the pixel, there is demand for sufficiently securing the capacity of the storage capacitor effectively using the given space and there is further demand for stably maintaining the voltage of the data signal stored in the storage capacitor.

SUMMARY OF THE INVENTION

According to an embodiment of the present invention, there is provided a pixel that stably maintains the voltage of a data signal stored in a storage capacitor, while sufficiently securing the capacity of the storage capacitor, and an organic light emitting display device having the same.

According to one aspect of the present invention, there is provided a pixel including: an organic light emitting diode that is coupled between a first power supply and a second power supply; a first transistor that is coupled between the first power supply and the organic light emitting diode and whose gate is connected to a first node; a second transistor that is coupled between the first node and a data line and whose gate electrode is coupled to a scan line; and a storage capacitor whose first electrode is coupled to the first node and second electrode is coupled to the first power supply, wherein the storage capacitor includes: a semiconductor layer that is positioned on a different layer from the data line and is expanded to a region where it is overlapped with the data line and constitutes the first electrode, a first dielectric layer that is formed on the semiconductor layer, a first conductive layer that is formed on the first dielectric layer and constitutes the second electrode, a second dielectric layer that is formed on the first conductive layer, and a second conductive layer that is formed on the second dielectric layer and constitutes the first electrode together with the semiconductor layer, the first conductive layer being positioned between the data line and the semiconductor layer in order to cover the upper part of the region where it is overlapped with the data line of the semiconductor layer.

According to another aspect of the present invention, the semiconductor layer may be made of the same material as activation layers of first and second transistors on the same layer, the first conductive layer may be made of the same material as gate electrodes of the first and second transistors on the same layer, and the second conductive layer may be made of the same material as source and drain electrodes of the first and second transistors on the same layer.

According to another aspect of the present invention, the semiconductor layer and the second conductive layer may be coupled to each other through a contact hole that penetrates through the first dielectric layer and the second dielectric layer.

According to another aspect of the present invention, the data line may be positioned on the upper part of the second dielectric layer.

According to another aspect of the present invention, a first power supply line that supplies first power may be positioned on the upper part of the second dielectric layer and be coupled to the first conductive layer through a contact hole that penetrates through the second dielectric layer.

According to another aspect of the present invention, there is provided an organic light emitting display device including: a plurality of pixels positioned on intersections of scan lines and data lines, wherein each pixel includes: an organic light emitting diode that is coupled between a first power supply and a second power supply; a first transistor that is coupled between the first power supply and the organic light emitting diode and whose gate is connected to a first node; a second transistor that is coupled between the first node and a data line and whose gate electrode is coupled to a scan line; and a storage capacitor whose first electrode is coupled to the first node and second electrode is coupled to the first power supply, wherein the storage capacitor including: a semiconductor layer that is positioned on a different layer from the data line and is expanded to a region where it is overlapped with the data line and constitutes the first electrode, a first dielectric layer that is formed on the semiconductor layer, a first conductive layer that is formed on the first dielectric layer and constitutes the second electrode, a second dielectric layer that is formed on the first conductive layer, and a second conductive layer that is formed on the second dielectric layer and constitutes the first electrode together with the semiconductor layer, the first conductive layer being positioned between the data line and the semiconductor layer in order to cover the upper part of the region where it is overlapped with the data line of the semiconductor layer.

According to another aspect of the present invention, the semiconductor layer that constitutes one electrode of the storage capacitor is formed to be expanded to the region where it is overlapped with the data line, making it possible to sufficiently secure the capacity of the storage capacitor effectively using the given space.

According to another aspect of the present invention, the first conductive layer that constitutes another electrode of the storage capacitor but is coupled to the first power supply is formed between the data line and the semiconductor layer and covers an upper surface of the semiconductor layer in the region where the semiconductor layer overlaps with the data line, making it possible to stably maintain the voltage of the data signal.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
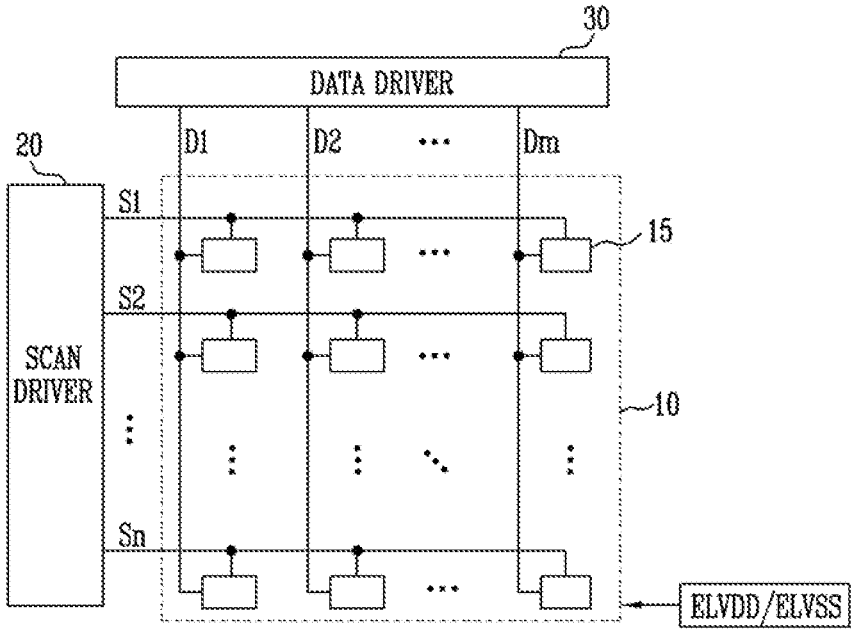
FIG. 1 is a block diagram showing the constitution of an organic light emitting display device according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

In the following detailed description, only certain exemplary embodiments of the present invention have been shown and described, simply by way of illustration. As those skilled in the art would realize, the described embodiments may be modified in various different ways, all without departing from the spirit or scope of the aspects of the present invention. Accordingly, the drawings and description are to be regarded as illustrative in nature and not restrictive. In addition, when an element is referred to as being "on" another element, it can be directly on the other element or be indirectly on the other element with one or more intervening elements interposed therebetween. Also, when an element is referred to as being "connected to" another element, it can be directly connected to the other element or be indirectly connected to the other element with one or more intervening elements interposed therebetween.

FIG. 1 is a block diagram showing the constitution of an organic light emitting display device according to an embodiment of the present invention. Referring to FIG. 1, the organic light emitting display device according to the embodiment of the present invention includes a pixel unit 10, a scan driver 20, and a data driver 30.

The pixel unit 10 includes a plurality of pixels 15 arranged on the intersections of scan lines S1 to Sn and data lines D1 to Dm in a matrix form and receives first power ELVDD and second power ELVSS from the outside (for example, a power supplier) to be driven. Herein, the first power supply ELVDD is set to a constant voltage source that supplies high pixel power and the second power supply ELVSS is set to a constant voltage source that supplies low pixel power.

The respective pixels 15 that constitute the pixel unit 10 store the data signals supplied from the data line D coupled to the pixels 15 when the scan signals are supplied from the scan line S coupled to the pixels 15, and emit light at the brightness corresponding thereto. Thereby, the image corresponding to the data signals is displayed on the pixel unit 10.

The scan driver 20 sequentially generates scan signals corresponding to the scan control signals supplied from the outside (for example, a timing controller). The scan signals generated from the scan driver 20 are supplied to the pixels 15 through the scan lines S1 to Sn.

The data driver 30 generates the data signals corresponding to the data and the data control signals supplied from the outside (for example, a timing controller). The data signals generated from the data driver 30 is supplied to the pixels 15 through the data lines D1 to Dm to be synchronized with the scan signals.

Figure 2:
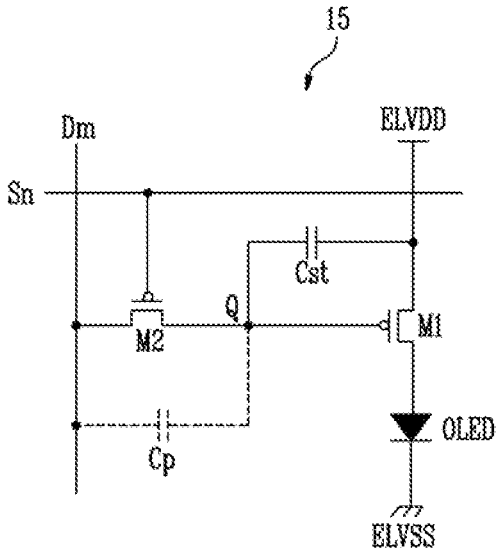
FIG. 2 is a circuit view showing one example of the pixel of FIG. 1.

FIG. 2 is a circuit view showing one example of the pixel of FIG. 1. For convenience of explanation, the pixel coupled between the n scan line Sn and the m data line Dm will be illustrated in FIG. 2.

However, a basic pixel having various structures that can be adopted to the pixel of an active matrix organic light emitting display device is illustrated in FIG. 2 by way of example, but the embodiment is not limited thereto. In addition, for a better explanation, the source and drain electrodes of first and second transistors M1 and M2 will be divided to be described hereinafter, but the source and drain electrodes may also be varied according to the type of transistor, the direction of current, the relative magnitude of the applied voltage, etc.

Referring to FIG. 2, the pixel 15 includes an organic light emitting diode OLED coupled between a first power supply ELVDD and a second power supply ELVSS, a first transistor M1 that is coupled between the first power supply ELVDD and the organic light emitting diode OLED and whose gate electrode is coupled to a first node Q, a second transistor M2 that is coupled between the first node Q and a data line Dm and whose gate electrode is coupled to a scan line Sn, and a storage capacitor Cst that is coupled between the first node Q and the first power supply ELVDD.

More specifically, the anode electrode of the organic light emitting diode OLED is coupled to the drain electrode of the first transistor M1, and the cathode electrode thereof is coupled to the second power supply ELVSS. Such an organic light emitting diode OLED emits light at the brightness corresponding to the driving current supplied from the first transistor M1.

The source electrode of the first transistor M1 is coupled to the first power supply ELVDD, the drain electrode thereof is coupled to the anode electrode of the organic light emitting diode OLED, and the gate electrode thereof is coupled to the first node Q. Such a first transistor M1 supplies the driving current having the magnitude corresponding to the voltage Vgs between the gate electrode and the source electrode of the first transistor M1. In other words, the first transistor M1 functions as the driving transistor of the pixel 15.

The source electrode of the second transistor M2 is coupled to the data line Dm, the drain electrode thereof is coupled to the first node Q, and the gate electrode thereof is coupled to the scan line Sn. When a low level scan signal is supplied from the scan line Sn, such a second transistor M2 is turned on to transfer the data signal from the data line Dm to the first node Q. In other words, the second transistor M2 functions as the switching transistor of the pixel 15.

The first electrode of the storage capacitor Cst is coupled to the first node Q and the second electrode thereof is coupled to the first power supply ELVDD and the source electrode of the first transistor M1. Such a storage capacitor Cst stores the voltage corresponding to the data signal supplied via the second transistor M2 and maintains it during the corresponding frame.

Accordingly the pixel 15 described above operates as follows, if the low level scan signal is supplied from the scan line Sn, the second transistor M2 is turned on. Therefore, the data signal from the data line Dm is supplied to the first node Q. At this time, the storage capacitor Cst stores the voltage corresponding to the data signal, that is, the differential voltage between the voltage of the first power supply ELVDD and the voltage of the data signal.

Herein, the voltage of the first power supply ELVDD is maintained at a predetermined value so that the voltage stored in the storage capacitor Cst is actually varied according to the data signal supplied to the first node Q.

Then, the first transistor M1 generates the voltage corresponding to the data signal, that is, the driving current having the magnitude corresponding to the voltage of the first node Q.

At this time, the driving current flows into the second power supply ELVSS from the first power supply ELVDD via the first transistor M1 and the organic light emitting diode OLED emits light at the brightness corresponding to the driving current.

In the pixel 15 as described above, the data signal stored in the storage capacitor Cst should be maintained at a predetermined value during the emission period of the corresponding frame so that the organic light emitting diode OLED is light-emitted at a uniform brightness during the emission period of each frame.

However, recently, as the resolution of the organic light emitting display device increases, the design space for designing the respective pixels 15 has been reduced.

Therefore, the space for designing the storage capacitor Cst has also been reduced so that if the capacity of the storage capacitor Cst is not sufficiently secured, the voltage corresponding to the data signal cannot be sufficiently stored during the period when the data signal is supplied to the inside of the pixel 15.

In this case, since the desired brightness cannot be obtained, the capacity of the storage capacitor Cst should be secured effectively using the limited design space. Therefore, the forming region of one electrode of the storage capacitor Cst may be expanded so that the storage capacitor Cst is disposed so as to overlap the scan line formed on the layer different from the one electrode.

For example, the first electrode of the storage capacitor Cst coupled to the first node Q may be disposed so as to overlap the data line Dm. However, in this case, a voltage fluctuation may be generated in the data signal stored in the storage capacitor even during the period when the emission period is continued, while a cross-talk phenomenon is generated by the parasitic capacity Cp formed between the first node Q and the data line Dm.

The voltage fluctuation is more noticeable when the data signal is supplied to the two pixels continuously disposed in neighboring rows and sharing the data line Dm.

For example, when the first pixel positioned in the previous row is supplied with the first data signal for displaying white and the second pixel positioned in the following row and sharing the data line with the first pixel is supplied with the second data signal for displaying black, the cross-talk phenomenon is generated by the parasitic capacitor Cp formed between the first node Q of the first pixel and the data line Dm. In this case, when the second data signal is supplied to the data line, the voltage of the first node Q of the first pixel in a floating state is increased and the brightness of the first pixel is degraded so that the first pixel may not completely display white.

The more detailed description thereof will be described below with reference to FIGS. 3A to 4.

Figure 3A:
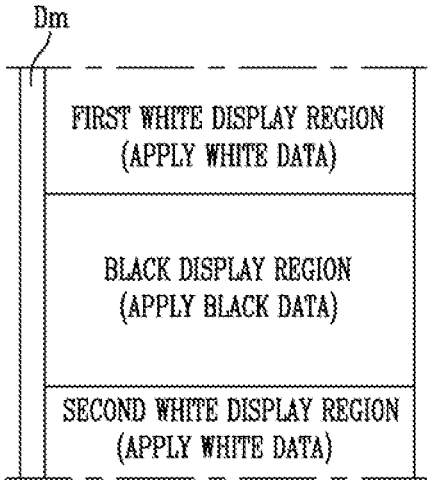
FIGS. 3A and 3B are plan views showing a cross-talk phenomenon.
Figure 3B:
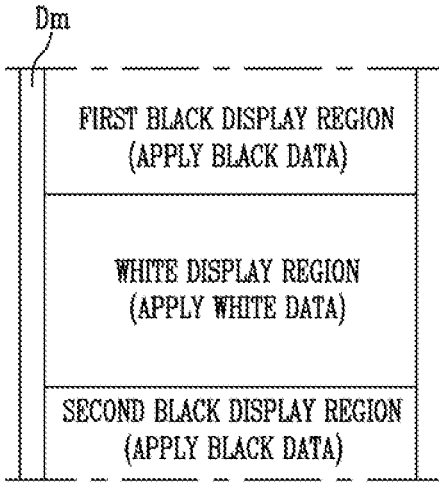

FIGS. 3A and 3B are plan views showing a cross-talk phenomenon. That is, FIGS. 3A and 3B are schematic plan views of the main parts of the embodiments where the pixels coupled to the same data line display images having great brightness difference per regions.

Figure 4:
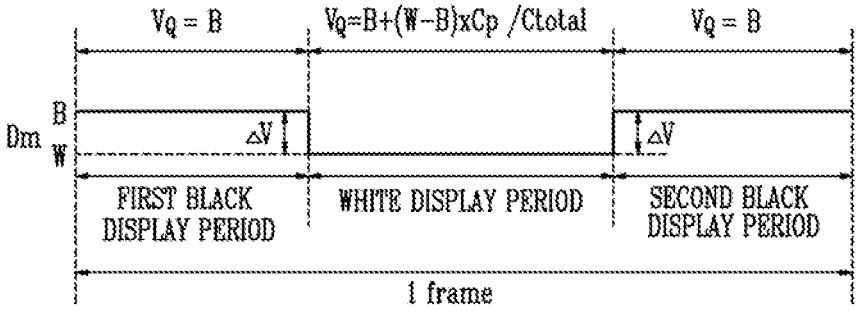
FIG. 4 is a waveform view showing the data signal input into a data line when displaying the image of FIG. 3B.

FIG. 4 is a waveform view showing the data signal input into a data line when displaying the image of FIG. 3B.

First, FIG. 3A, exemplifies a case where the pixels positioned on the upper horizontal lines and the lower horizontal lines of a plurality of pixels coupled to the same data line Dm and disposed sequentially on the respective horizontal lines display white and the pixels positioned on the intermediate horizontal lines display black.

Herein, the pixels positioned on the upper horizontal lines to receive white data, that is, the white gray scale data signal, will be referred to as first pixels and the region that displays white through the first pixels will be referred to as a first white display region. Also, the pixels positioned on the intermediate horizontal lines to receive black data, that is, the black gray scale data signal, will be referred to as second pixels and the region that displays black through the second pixels will be referred to as a black display region. And, the pixels positioned on the lower horizontal lines to receive white data will be referred to as third pixels and the region that displays white through the third pixels will be referred to as a second white display region.

In this case, while the cross-talk phenomenon is generated by the parasitic capacitor formed between the first node Q of the first pixels and the data line Dm from the time point when the second pixels are selected and the data signals of the second pixels are applied to the data line Dm, the voltage of the first node Q of the first pixels is raised so that the brightness of the first pixels my be degraded. In other words, compared with the pixels displaying only white in other rows, the first pixels may not completely display white, while emitting light at a relatively low brightness.

In addition, the first pixels completely display white from the time point when the third pixels are selected and the data signals of the third pixels are applied to the data line Dm, but the voltage of the first node of the second pixels is dropped so that the brightness may be enhanced. In other words, compared with the pixels displaying only black in other rows, the second pixels may not completely display black, while emitting light at a relatively high brightness, during the period when the white data is applied to the third pixels.

Moreover, FIG. 3B, exemplifies a case where the pixels positioned on the upper horizontal lines and the lower horizontal lines of a plurality of pixels coupled to the same data line Dm display black and the pixels positioned on the intermediate horizontal lines display white.

In this case, the black brightness of the first pixels positioned on the first black display region is enhanced from the time point when the white data is applied from the second pixels positioned on the white display region. And, the first pixels completely display black from the time point when the black data is applied to the third pixels positioned on the second black display region but the white brightness of the second pixels is degraded so that it cannot completely display white.

More specifically, when displaying the image described in FIG. 3B, and shown in FIG. 4, the black data is applied to the data line Dm during the first black display period where the first pixels on the first black display region are selected, the white data is applied to the data line Dm during the white display period where the second pixels on the white display region are selected, and the black data is applied again to the data line Dm during the second black display period where the third pixels on the second black display region are selected.

Herein, the black data is set to high level black gray scale data signal so that the voltage Vgs between the gate electrode and the source electrode of the first transistor M1 as shown in FIG. 2 becomes small and the white data is set to low level white gray scale data signal so that the voltage Vgs between the gate electrode and the source electrode of the first transistor M1 becomes large. For convenience of explanation, hereinafter the first node voltage $V_Q$ when the black data is supplied will be referred to as B and the first node voltage $V_Q$ when the white data is supplied will be referred to as W.

Based on the first node voltage $V_Q$ of the first pixels, the first node voltage $V_Q$ of the first pixels is maintained as B during the first black display period and the voltage fluctuation value by the cross-talk phenomenon is added to the conventional B so that the voltage of the first node voltage $V_Q$ of the first pixels is fluctuated by the voltage division amount by the capacitance Cp of the parasitic capacitor and the total capacitance Ctotal of the pixel during the white display period. Therefore, as the first node voltage $V_Q$ of the first pixels is dropped, the black brightness is enhanced.

Thereafter, if the black data is supplied to the data line Dm during the second black display period, the first node voltage $V_Q$ of the first pixels is raised again to B and the black brightness is degraded, making it possible to completely display black.

In other words, the first pixels display abnormal black having higher brightness than normal black during the white display period where the white data is applied to the second pixels, and the period where the first pixels display the abnormal black is increased as the white display period is increased.

As described above, the pixels emitting light can be abnormally affected by the voltage fluctuation in the data line Dm during the emission period where the first node Q is floated, while the cross-talk phenomenon is generated by the parasitic capacitor Cp formed due to the storage capacitor Cst overlapping with the data line Dm.

Therefore, according to an aspect of the present invention, there is provided a method to prevent the cross-talk phenomenon and a detailed description thereof will be described later with reference to FIG. 5.

Figure 5:
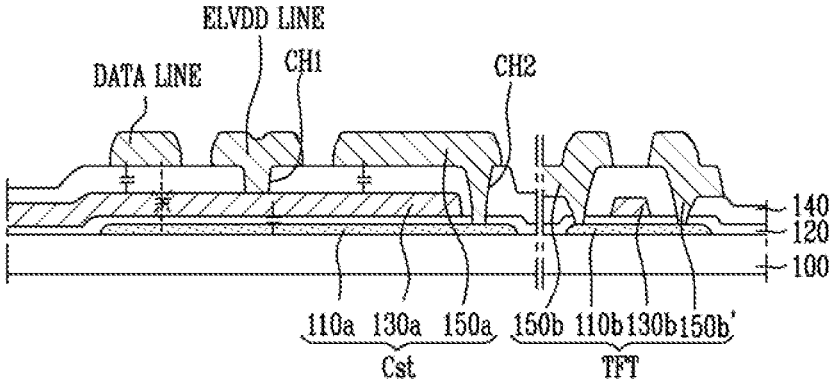
FIG. 5 is a cross-sectional view of a main part of a pixel according to an embodiment of the present invention.

FIG. 5 is a cross-sectional view of a main part of a pixel according to an embodiment of the present invention. For convenience of explanation, only one transistor of first and second transistors will be illustrated in FIG. 5, wherein the basic structure thereof can be designed in the same manner so that they will be collectively referred to as a TFT. And, the illustration of the coupling parts between the TFT and other constituents and the upper part (organic light emitting diode, etc.) of the TFT will be omitted.

Referring to FIG. 5, a storage capacitor Cst includes a semiconductor layer 110*a*, a first conductive layer 130*a*, and a second conductive layer 150*a*, that are stacked sequentially on a substrate 100. Herein, a first dielectric layer 120 is interposed between the semiconductor layer 110*a* and the first conductive layer 130*a* and a second dielectric layer 140 is interposed between the first semiconductor layer 130*a* and the second conductive layer 150*a*, wherein the semiconductor layer 110*a* and the second conductive layer 150*a* contact each other through a contact hole CH2 that penetrates the first and second dielectric layers 120 and 140.

Meanwhile, although the first and second dielectric layers 120 and 140 are shown in FIG. 5 as being excluded from the constituents of the storage capacitor Cst, they are interposed between the semiconductor layer 110*a* and the first conductive layer 130*a* and between the first conductive layer 130*a* and the second conductive layer 150*a* so that they may be regarded as the constituents of the storage capacitor Cst.

More specifically, the storage capacitor Cst includes the semiconductor layer 110*a* formed on the substrate 100, the first dielectric layer 120 formed on the semiconductor layer 110*a*, the first conductive layer 130*a* formed on the first dielectric layer 120, the second dielectric layer 140 formed on the first conductive layer 130*a*, and the second conductive layer formed on the second dielectric layer 140.

The semiconductor layer 110*a* may be made of the same material as an activation layer 110*b* of the TFT formed on the same layer. Such a semiconductor layer 110*a*, which constitutes the first electrode of the storage capacitor Cst, is coupled to the first node Q not shown in FIG. 5 but shown in FIG. 2.

The first dielectric layer 120 is interposed between the semiconductor layer 110*a* and the first conductive layer 130*a* of the storage capacitor Cst. Such a first dielectric layer 120, which may be formed in common through the pixel unit, also functions as the gate dielectric layer that isolates the activation layer 110*b* from the gate electrode 130*b* of the TFT.

The first conductive layer 130*a* of the storage capacitor Cst may be made of the same material as the gate electrode 130*b* of the TFT formed on the first dielectric layer 120. Such a first conductive layer 130*a*, which constitutes the second electrode of the storage capacitor Cst, is coupled to a first power supply line through a contact hole CH1 that penetrates the second dielectric layer 140. Herein, the first power supply line, which supplies first power ELVDD, may be made of the same material as the source and drain electrodes 150*b* and 150*b*' of the TFT formed on the same layer as the power supply line (that is, the upper part of the second dielectric layer 140).

The second dielectric layer 140 is interposed between the first conductive layer 130*a* and the second conducive layer 150*a* of the storage capacitor Cst. Such a second dielectric layer 140, which may be formed in common through the pixel unit, also functions as an interlayer dielectric layer that isolates the gate electrode 130*b* from the source and drain electrodes 150*b* and 150*b*' of the TFT.

The second conductive layer 150*a* may be made of the same material as the source and drain electrodes 150*b* and 150*b*' of the TFT formed on the same layer as the second conductive layer 150*a*. Such a second conductive layer 150*a*, which is coupled to the semiconductor layer 110*a* through the contact hole CH2 that penetrates the first and second dielectric layers 120 and 140, constitutes the first electrode of the storage capacitor Cst together with the semiconductor layer 110*a*.

However, in the embodiment, the semiconductor layer 110*a* is positioned on the different layer from the data line but is expanded to the region where the semiconductor layer 110*a* overlaps with the data line. And, the first conductive layer 130*a* is positioned in one region, in particular, between the data line and the semiconductor layer 110*a*, in order to cover the upper part of the semiconductor layer 110*a* in the region where the semiconductor layer 110*a* overlaps with the data line.

Herein, the data line is formed on the different layer from the semiconductor layer 110*a* and the first conductive layer 130*a*, for example, on the upper part of the second dielectric layer 140. In this case, the data line may be made of the same material as that of the second conductive layer 150*a* of the storage capacitor and that of the source and drain electrodes 150*b* and 150*b*' of the TFT formed on the same layer as the data line.

Accordingly, in the embodiment described above, the semiconductor layer 110*a* that constitutes one electrode (first electrode) of the storage capacitor Cst is expanded to the region where the semiconductor layer 110*a* overlaps with the data line, making it possible to secure the capacity of the storage capacitor Cst.

In particular, the first conductive layer 130*a*, that forms the other electrode (second electrode) of the storage capacitor Cst and is coupled to the first power supply ELVDD that is the constant voltage source, covers the upper part of the semiconductor layer 110*a* in the region where the semiconductor layer 110*a* overlaps with the data line between the data line. Thereby, when the data signal is supplied to the pixels on other horizontal lines, the effects of the voltage fluctuation of the data line to the voltage of the first node Q coupled to the semiconductor layer 110*a* are blocked. Therefore, the voltage of the data signal supplied to the first node Q can be stably maintained.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A pixel comprising:

an organic light emitting diode that is coupled between a first power supply to supply a first power and a second power supply to supply a second power;

a first transistor that is coupled between the first power supply and the organic light emitting diode and having a gate that is connected to a first node;

a second transistor that is coupled between the first node and a data line and having a gate electrode that is coupled to a scan line; and a storage capacitor having a first electrode that is coupled to the first node and second electrode that is coupled to the first power supply, wherein the storage capacitor includes: a semiconductor layer that is positioned on a different layer from that of the data line, a first dielectric layer that is formed on the semiconductor layer, a first conductive layer that is formed on the first dielectric layer and forms the second electrode, a second dielectric layer that is formed on the first conductive layer, and a second conductive layer that is formed on the second dielectric layer and forms the first electrode together with the semiconductor layer, the first conductive layer being positioned between the data line and the semiconductor layer to cover an upper surface of a region where the semiconductor layer overlaps with the data line and wherein the semiconductor layer extends continuously from a region overlapping with the second conductive layer to the region where the semiconductor layer overlaps with the data line to form the first electrode, wherein the semiconductor layer and activation layers of the first and second transistors are formed on a same layer and the semiconductor layer is of a same material as the activation layers of the first and second transistors, and wherein at least a portion of the first dielectric layer is located between the semiconductor layer and the activation layers of the first and second transistors.

2. The pixel as claimed in claim 1, wherein, the first conductive layer and gate electrodes of the first and second transistors are formed on a same layer and the first conductive layer is of a same material as the gate electrodes of the first and second transistors, and the second conductive layer and source and drain electrodes of the first and second transistors are formed on a same layer and the second conductive layer is of a same material as the source and drain electrodes of the first and second transistors.

3. The pixel as claimed in claim 1, wherein the semiconductor layer and the second conductive layer are coupled to each other through a contact hole that penetrates the first dielectric layer and the second dielectric layer.

4. The pixel as claimed in claim 1, wherein the data line is positioned on an upper surface of the second dielectric layer.

5. The pixel as claimed in claim 4, wherein the data line and the second conductive layer are formed on a same layer and the data line is of a same material as the second conductive layer.

6. The pixel as claimed in claim 1, wherein a first power supply line that supplies the first power is positioned on the upper surface of the second dielectric layer and is coupled to the first conductive layer through a contact hole that penetrates the second dielectric layer.

7. The pixel as claimed in claim 1, wherein the first power is a constant voltage source that supplies high pixel power.

8. An organic light emitting display device comprising:

a plurality of pixels positioned on intersections of scan lines and data lines, wherein each pixel includes:

an organic light emitting diode that is coupled between a first power supply to supply a first power and a second power supply to supply a second power;

a first transistor that is coupled between the first power supply and the organic light emitting diode, the first transistor having a gate that is connected to a first node;

a second transistor that is coupled between the first node and a data line, the second transistor having a gate electrode that is coupled to a scan line; and a storage capacitor having a first electrode that is coupled to the first node and a second electrode that is coupled to the first power supply, wherein the storage capacitor includes: a semiconductor layer that is positioned on a different layer from that of the data line, a first dielectric layer that is formed on the semiconductor layer, a first conductive layer that is formed on the first dielectric layer and forms the second electrode, a second dielectric layer that is formed on the first conductive layer, and a second conductive layer that is formed on the second dielectric layer and forms the first electrode together with the semiconductor layer, the first conductive layer being positioned between the data line and the semiconductor layer to cover an upper surface of a region where the semiconductor layer overlaps with the data line of the semiconductor layer and wherein the semiconductor layer extends continuously from a region overlapping with the second conductive layer to the region where the semiconductor layer overlaps with the data line to form the first electrode, wherein the semiconductor layer and activation layers of the first and second transistors are formed on a same layer and the semiconductor layer is of a same material as the activation layers of the first and second transistors, and wherein at least a portion of the first dielectric layer is located between the semiconductor layer and the activation layers of the first and second transistors.

9. The organic light emitting display device as claimed in claim 8, wherein, the first conductive layer and gate electrodes of the first and second transistors are formed on a same layer, and the first conductive layer is made of a same material as the gate electrodes of the first and second transistors, and the second conductive layer and source and drain electrodes of the first and second transistors are formed on a same layer and the second conductive layer is of a same material as the source and drain electrodes of the first and second transistors.

10. The organic light emitting display device as claimed in claim 8, wherein the semiconductor layer and the second conductive layer are coupled to each other through a contact hole that penetrates the first dielectric layer and the second dielectric layer.

11. The organic light emitting display device as claimed in claim 8, wherein the data line and the second conductive layer are formed on a same layer and the data line is of a same material as the second conductive layer.

12. The organic light emitting display device as claimed in claim 8, the first power is a constant voltage source that supplies high pixel power.

13. A storage capacitor of a pixel of an organic light emitting display device including an organic light emitting diode coupled between a first power supply and a second power supply; a first transistor coupled between the first power supply and the organic light emitting diode and having a gate that is connected to a first node; and a second transistor coupled between the first node and a data line and having a gate electrode coupled to a scan line, the storage capacitor comprising:

a semiconductor layer that is formed on a substrate;

a first dielectric layer that is formed on the semiconductor layer;

a first conductive layer that is formed on the first dielectric layer;

a second dielectric layer that is formed on the first conductive layer; and a second conductive layer that is formed on the second dielectric layer and forms a first electrode of the storage capacitor together with the semiconductor layer, wherein the data line overlaps a region of the semiconductor layer and a region of the first conductive layer, wherein the semiconductor layer extends continuously from a region overlapping with the second conductive layer to the region where the semiconductor layer overlaps with the data line to form the first electrode, wherein the semiconductor layer and activation layers of the first and second transistors are formed on a same layer and the semiconductor layer is of a same material as the activation layers of the first and second transistors, and wherein at least a portion of the first dielectric layer is located between the semiconductor layer and the activation layers of the first and second transistors.

14. The storage capacitor as claimed in claim 13, wherein the semiconductor layer and the second conductive layer are coupled to each other through a contact hole formed on the first dielectric layer and the second dielectric layer.

15. The storage capacitor as claimed in claim 13, wherein the first conductive layer and gate electrodes of the first and second transistors are formed on a same layer and the first conductive layer is of a same material as the gate electrodes of the first and second transistors.

16. The storage capacitor as claimed in claim 13, wherein the second conductive layer and source and drain electrodes of the first and second transistors are formed on a same layer and the second conductive layer is of a same material as the source and drain electrodes of the first and second transistors.

17. The storage capacitor as claimed in claim 13, wherein a first power supply line that supplies a first power to the pixel is positioned on an upper surface of the second dielectric layer and is coupled to the first conductive layer through a contact hole that traverses the second dielectric layer.

18. The storage capacitor as claimed in claim 17, wherein the first power is a constant voltage source that supplies high pixel power to the pixel.

* * * * *